United States Patent [19]

Kothmann

[11] 4,179,240

[45] Dec. 18, 1979

[54] COOLED TURBINE BLADE

[75] Inventor: Richard E. Kothmann, Churchill, Pa.

[73] Assignee: Westinghouse Electric Corp., Pittsburgh, Pa.

[21] Appl. No.: 828,466

[22] Filed: Aug. 29, 1977

[51] Int. Cl.[2] ..... F01D 5/18

[52] U.S. Cl. ..... 416/96 R; 415/114

[58] Field of Search ..... 416/92, 95, 97; 415/114

[56] References Cited

U.S. PATENT DOCUMENTS

| | | | |
|---|---|---|---|
| 2,667,326 | 1/1954 | Ledinegg | 416/96 |
| 2,868,500 | 1/1959 | Boulet | 416/96 |
| 2,883,151 | 4/1959 | Dolida | 416/96 |
| 3,191,908 | 6/1965 | Powell et al. | 416/96 X |
| 3,550,372 | 12/1970 | Craig | 415/114 X |
| 3,816,022 | 6/1974 | Day | 416/97 X |
| 3,902,819 | 9/1975 | Holchendler et al. | 416/97 X |
| 4,118,145 | 10/1978 | Stahl | 416/96 R |

*Primary Examiner*—Everette A. Powell, Jr.
*Attorney, Agent, or Firm*—F. A. Winans

[57] ABSTRACT

A water-cooled turbine rotor blade having an enlarged radially-extending chamber forming a coolant reservoir connected to cooling passages subadjacent the blade surface. The channels interconnecting the reservoir with the passages are adjacent the blade tip so that the pressurized water (i.e., due to the centrifugal force caused by the rotation) in the reservoir flows into the channels at the tip and thence through the cooling passages radially inwardly. Heat absorption from the blade causes vaporization of the water as it flows through the passages. The cooling passages terminate radially inwardly (adjacent the hub or root portion) in a space in flow communication with the enlarged chamber and an exhaust port in the downstream face of the root so that vapor is exhausted at the downstream face and any liquid exiting the coolant passages is returned to the reservoir.

6 Claims, 2 Drawing Figures

COOLED TURBINE BLADE

BACKGROUND OF THE INVENTION

1. Field of the Invention

This invention relates to a cooled turbine blade and more particularly to a water-cooled blade.

2. Description of the Prior Art

Water-cooled gas turbine rotor blades are well known in the art as typified by U.S. Pat. Nos. 3,804,551 and 3,736,071 in which the water enters the blade adjacent the blade root and flows in a generally radially outwardly direction through cooling passages subadjacent the skin of the blade to ultimately be exhausted into the motive gas stream of the gas turbine, substantially in vapor form. However, in such an enviroment, because of the large centrifugal force field and because of the difference in densities of the fluid, the radially outward flow of the cooler water tends to overtake the outward flow of the vapor, causing vapor blockage of the coolant flow through the passages, thereby reducing the heat flux capability of the passages and ultimately causing the blade to fail from overheating. Also, fluid flow through a cooling channel is inherently unstable when boiling occurs therein if the flow direction coincides with the gravitational or force field. This is particularly critical in parallel channels having a common reservoir wherein such flow can cause one channel to become substantially filled with liquid, which because of the then increased density of the fluid in this channel, causes more liquid flow into this channel which may starve the flow to the other channels, causing overheating in their vicinity.

One attempt to overcome the above deficiencies is illustrated in U.S. Pat. No. 3,902,819 wherein the water flowing through the coolant passages is maintained at a supercritical pressure so that it cannot vaporize and cause the blockage or unstable flow. However, this reduces substantially the amount of heat that can be absorbed (i.e., the heat for vaporization being a considerable portion of the cooling capability of the previous referenced blade configurations) and requires any make-up water to be introduced at the supercritical pressure in the system.

Another approach to the problem of eliminating steam pockets, from the coolant passages to enhance the heat transfer is shown in copending commonly assigned patent application Ser. No. 773,461 wherein intermediate enlarged chambers are provided in the coolant passages to permit the heated coolant (water) to flash to steam, with the steam being vented in a separate path from the coolant flow which continues to an exhaust port adjacent the blade tip. However, ultimately, it is expected that water will vaporize prior to being exhausted at the tip.

SUMMARY OF THE PRESENT INVENTION

The present invention provides a water-cooled blade having an interior chamber providing a pressurizing reservoir in flow communication with a plurality of outer cooling passages through connecting passages subadjacent the blade tip. The radially innermost termination of the cooling passages discharges into the interior chamber which is also in communication with an exit port in the downstream face of the blade. Water is delivered to the chamber through a coolant inlet passage and is collected and pressurized therein by the strong centrifugal force field. The water then enters the cooling passages through the interconnecting passage at the blade tip and, in flowing through the cooling passages, is heated to saturation and at least partially evaporated before exiting. The density difference between the cool fluid in the pressurizing reservoir and a fluid/vapor mixture in the passages provides the pressure difference required to force the flow through the channels to the passages. The evaporation process in the cooling passages occurs in the same direction as the flow (i.e., opposite to the centrifugal force field) thus permitting escape of the vapors without any tendency to block the flow and providing an inherent stable cooling fluid flow even with boiling.

The exhaust of the water or the vapor and water mixture into the central chamber makes use of the centrifugal force field to separate the water from the vapor, returning the water for recirculation and exhausting only that portion which has vaporized, thereby minimizing makeup water and the thermodynamic penalty associated with exhausting excess water to the motive fluid flow path.

DESCRIPTION OF THE PREFERRED EMBODIMENTS

Figure 1:
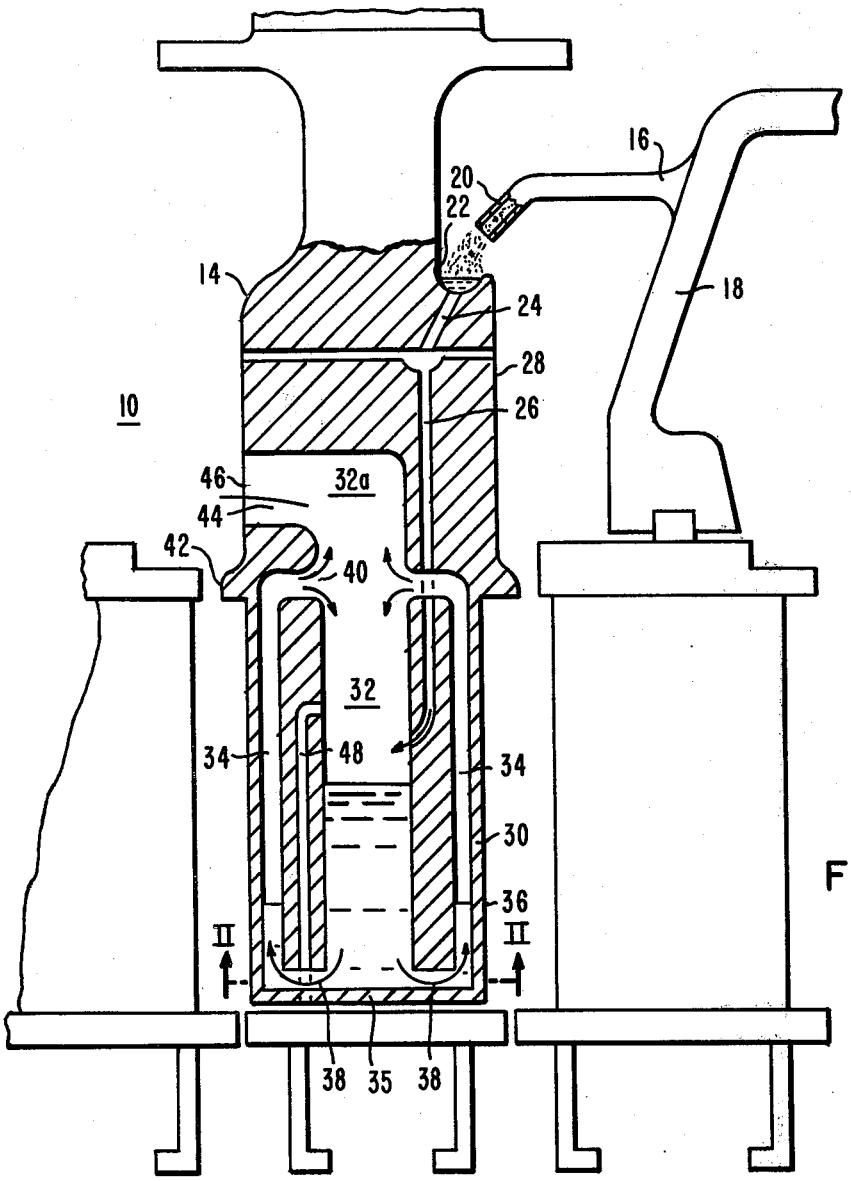
FIG. 1 is an elevational, cross-sectional schematic of the blade of the present invention in a gas-turbine engine; and, FIG. 2 is a view generally along lines II—II of FIG. 1.

Referring to FIG. 1, the cooled blade 10 of the present invention is shown mounted in a rotor disc 14 of a gas turbine engine. The preferred coolant fluid is water which is delivered to a blade by a supply manifold 16 mounted on the diaphragm 18 and having nozzles 20 for injecting water into a gutter 22 formed in the rotor. A coolant delivery passage 24, subadjacent each blade, leads from the gutter to an aligned passage 26 in the blade root portion 28. Passage 26 extends generally radially to the root portion 28 into the interior of the airfoil portion 30 of the blade 10 to terminate in an enlarged chamber 32 extending generally radially from subadjacent the blade tip 34 to the root portion 28.

A plurality of cooling passages 34 extend radially across the airfoil portion 30 of the blade just below the surface 36 thereof and are interconnected to the chamber 32 through passageways 38 at the tip, and exhaust back into the radially inner portion **32*a* of the chamber 32 through return passages 40**.

The radially innermost portion **32*a* of the chamber 32 exhausts to the downstream side 42 of the root portion 28 of the blade 10 through an axially extending exhaust channel 44 and exhaust port 46**.

An overflow passage 48 is provided which extends from the chamber 32 radially inwardly of the discharge of the inlet passage 26 through the tip 34 of the blade to limit the amount of water contained in the chamber 32.

Figure 2:
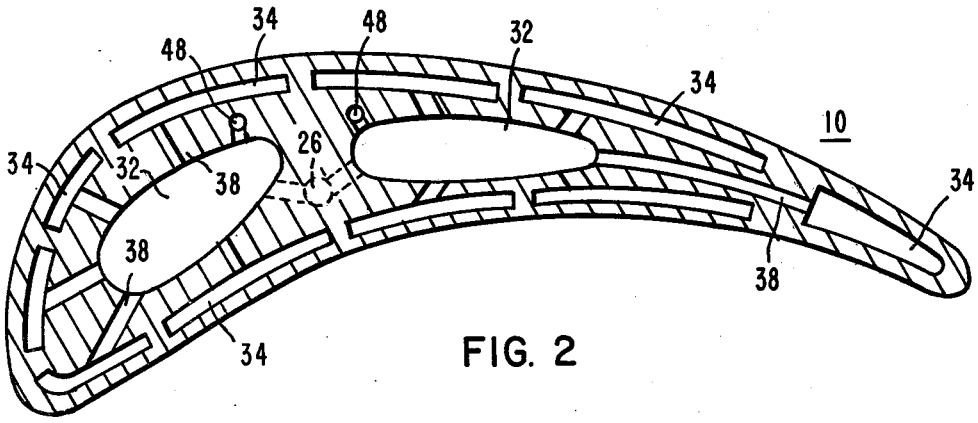

Referring now to FIG. 2, it is seen that the blade 10 may contain more than one enlarged chamber 32, with each chamber connected to a plurality of separate cooling passages 34 through innerconnecting passageways 38. It is evident that each enlarged chamber 32 could have independent exhaust channels 44 (not shown in this view) and overflow passages 48 or, each could be in fluid communication with a common exhaust channel and also a common overflow passage if desired.

In operation, water is supplied to the gutter 22 from the nozzle 20 and, under the influence of the centrifugal force field, flows through the passages 24, 26 and into the enlarged chamber 32.

The water is contained within the chamber 32, and under the strong centrifugal force field, is pressurized and forced through the innerconnecting passages 38 at the tip of the blade into the cooling passages 34.

As the water flows through the cooling passages, it absorbs the heat flux from the blade and is thereby heated to saturation and partially evaporates before leaving the passages and returning to the chamber 32 through passage 40. It is noted that the direction of flow of the water in the cooling passages and the direction of vapor flow from the boiling thereof are both radially inwardly, thereby eliminating any blockage of the water flow by the vapor which occurs when there is a tendency for counterflow therebetween or for the water flow to overtake the flow of the escaping vapors. This flow direction, which is determined by the water in the cooling passages being heated and thus less dense than the water in the pressurizing reservoir thereby providing the pressure difference required to force the flow through the passages, results in an inherent relatively stable fluid flow for continuous heat removal by the water. This stability of flow provided by having the boiling flow direction coincide with the force field permits the desirable use of multiple cooling passages 34 being fed in parallel from a common reservoir 32 without the necessity of metering each passage to insure the proper quantity of flow therethrough.

The arrangement whereby the cooling fluid or water is exhausted into the chamber 32 after it has absorbed the heat makes it possible to utilize the strong centrifugal force field to separate the unevaporated water from the vapor and return the water to the reservoir for recirculation while exhausting the vapor through the exhaust channel 44 and port 46 on a downstream face of the blade. Thus, the exhaust of the coolant fluid from the blade will be only vapor.

Because the heat in the blade during low temperature start-up conditions is insufficient to vaporize the water in the cooling passages, the continued entry of water into the central chamber 32 may overfill the chamber such that the pressure caused by the centrifugal force on the water and supported by the blade tip 38 may cause excessive stress on the tip. To prevent such an occurrence, overflow passage 48 is provided which limits the depth (or head as indicated by L) of water in the chamber to the level of the entry to this overflow passage 48 such that all additional water added will flow out the blade tip until vaporization starts to occur. Once the vaporization cooling is established for continuous operation of the turbine, the amount of water added and the amount of vapor exhausted should be balanced.

Thus, the cooling flow scheme of the blade of the present invention utilizes the boiling of the water to maximize its cooling capability yet establishes the flow of vapor release and the flow of the water in a common direction to prevent the blocking or instability of flow previously associated with a phase change of the coolant in the coolant passage of a blade. Further, the cooling flow pattern permits recirculation of the liquid coolant and exhausts only vapor to minimize the effects of the used coolant on the motive fluid driving the engine and permits adding the make-up water to the blade at the turbine stage pressure rather than a supercritical pressure heretofore associated with coolant blades having recirculation.

I claim:

1. A fluid cooled gas turbine blade having an airfoil portion and a root portion with at least one radially extending chamber within the airfoil portion of said blade, a first fluid channel providing a liquid coolant inlet to said chamber, a plurality of second fluid channels subadjacent the blade surface in said airfoil portion, each of said second channels having an inlet in fluid communication with said chamber subadjacent the top of said blade and an outlet in fluid communication with said chamber generally adjacent the root portion of said blade, a third fluid channel providing fluid communication from said chamber to exit the blade adjacent said tip, the entry to said third channel from within said chamber being disposed at an intermediate position in the radial extent of said chamber and generally radially inwardly of the desired depth of fluid accumulated therein to limit the depth of said fluid in said chamber from adjacent said tip to said entry position whereby any further fluid entering said chamber will exit via said third channel, and, an exhaust channel providing vapor flow communication from said chamber to exit said blade on the downstream face thereof adjacent said root portion whereby, liquid cooling fluid entering said blade is collected in said chamber and under the generally high centrifugal force field of said blade when rotating enters each of said plurality of second channels for flow therethrough promoting vaporization of the liquid to cool the blade, and wherein the flow of the fluid in said second channels and the flow of said vapor generated therein are in a common direction from said tip to said root portion to provide stability for the fluid flow through all said second channels.

2. Blade structure according to claim 1 wherein said chamber extends generally radially substantially across the airfoil portion of said blade and wherein the fluid exiting said second channels into said chamber is separated, under the influence of the centrifugal force field, into liquid for retention in said chamber for recirculation, and vapor exhausted through said exhaust channel.

3. Blade structure according to claim 2 wherein said blade defines more than one of said chambers, and wherein each of said chambers has a plurality of said second channels in flow communication therewith.

4. In a gas turbine engine having a rotor disc and a plurality of blades secured thereto through root portions engaging said disc, said blades also defining an airfoil portion in the path of hot motive gases and a root portion, and means for cooling said blades, said means comprising coolant fluid delivery means for directing said fluid to a circumferential gutter in said disc, a coolant fluid inlet passage in said disc subadjacent each cooled blade therein for directing said fluid to the root portion of said blade and wherein said blade defines a first internal channel providing a liquid coolant inlet in communication with a generally radially extending chamber within the airfoil portion of said blade, a plurality of second fluid channels subadjacent the blade surface in said airfoil portion, each of said second channels having an inlet in fluid communication with said chamber subadjacent the tip of said blade and an outlet in fluid communication with said chamber generally adjacent the root portion of said blade, a third channel providing fluid communication from said chamber to exit the blade adjacent said tip, the entry to said third channel from within said chamber being disposed at an intermediate position in the radial extent of said chamber and generally radially inwardly of the desired depth of fluid accumulated therein to limit the depth of said fluid in said chamber from adjacent said tip to said entry position whereby and further fluid entering said chamber will exit via said third channel, and, an exhaust channel providing vapor flow communication from said chamber to exit said blade on the downstream face thereof adjacent said root portion whereby, liquid cooling fluid entering said blade is collected in said chamber and under the generally high centrifugal force field of said blade when rotating enters each of said plurality of second channels for flow therethrough promoting vaporization of the liquid to cool the blade, and wherein the flow of the fluid in said second channels and the flow of said vapor generated therein are in a common direction from said tip to said root portion to provide stability for the fluid flow through all said second channels.

5. Structure according to claim 4 wherein said chamber extends generally radially substantially across the airfoil portion of said blade and wherein the fluid exiting said second channels into said chamber is separated, under the influence of the centrifugal force field, into liquid for retention in said chamber for recirculation, and vapor exhausted through said exhaust channel.

6. Structure according to claim 5 wherein said blade defines more than one of said chambers and wherein each of said chambers has a plurality of said second channels in flow communication therewith.

* * * * *